United States Patent [19]

Meredith

[11] Patent Number: 4,902,381

[45] Date of Patent: Feb. 20, 1990

[54] METHOD OF BLEACHING PULP WITH OZONE-CHLORINE MIXTURES

[75] Inventor: Michael D. Meredith, Glens Falls, N.Y.

[73] Assignee: Kamyr, Inc., Glens Falls, N.Y.

[21] Appl. No.: 281,752

[22] Filed: Dec. 9, 1988

[51] Int. Cl.[4] ..... D21C 9/12; D21C 9/147; D21C 9/153; D21C 9/14

[52] U.S. Cl. ..... 162/65; 162/66; 162/88; 162/89

[58] Field of Search ..... 162/66, 87, 88, 89, 162/65 A, 65 B, 57

[56] References Cited

U.S. PATENT DOCUMENTS

| | | | |
|---|---|---|---|
| 396,325 | 1/1889 | Brin | 162/65 |
| 1,957,937 | 5/1934 | Campbell et al. | 162/65 |
| 4,080,249 | 3/1978 | Kempf et al. | 162/65 |
| 4,093,506 | 6/1978 | Richter | 162/65 |
| 4,372,812 | 2/1983 | Phillips et al. | 162/65 |

FOREIGN PATENT DOCUMENTS

| | | | |
|---|---|---|---|
| 966604 | 4/1975 | Canada | 162/65 |
| 131005 | 10/1979 | Japan | 162/65 |
| 937580 | 6/1982 | Japan | 162/65 |

OTHER PUBLICATIONS

Liebergott et al, "The Use of Ozone in Bleaching and Brightening Wood Pulps", *Tappi,* Pulp & Paper Seminar, Nov. 1978.

Enz et al, "Oxidative Extraction: An Opportunity of Splitting the Bleach Plant", *Tappi,* Jun. 1984.

Singh, "Ozone Replaces Chlorine in the First Bleaching Stage", *Tappi,* vol. 65, No. 2, Feb. 1982.

Berry et al, "Using Oxygen-Alkali Extraction to Simplify the Chlorination Stage", J. Pulp & Paper Science, vol. 12, No. 5; Sep. 1986.

*Primary Examiner*—Steve Alvo

*Attorney, Agent, or Firm*—Nixon & Vanderhye

[57] ABSTRACT

Ozone and chlorine are used to bleach cellulosic fibrous material pulp in the production of kraft pulp for paper and paper products, being applied together in a mixture. When the ozone and chlorine are applied simultaneously it is possible to achieve delignification to a greater extent than is possible utilizing chlorine at any level. The total chlorinated ring compounds in the bleach plant effluent are remarkably reduced utilizing the ozone-chlorine mixture, compared to all chlorine, with resulting decrease in the fish toxicity of the bleach plant effluent. Utilizing an $O_3/Cl_2$ $E_o$ D bleaching sequence (only three stages) it is possible to obtain pulp with 90 TAPPI Absolute, or greater, brightness.

10 Claims, 2 Drawing Sheets

METHOD OF BLEACHING PULP WITH OZONE-CHLORINE MIXTURES

BACKGROUND AND SUMMARY OF THE INVENTION

Chlorine is one of the most widely used bleaching agents in the bleaching of cellulosic fibrous material pulp, particularly in the bleaching of kraft pulp in the production of paper and paper products. However chlorine is coming under increasing attack because of the possible adverse affects on the environment, such as the production of effluents that are toxic to fish. Also, bleaching with chlorine alone means a fairly low ceiling of brightness.

It is well known that ozone is environmentally superior to chlorine in the bleaching of pulp, since ozone does not produce chlorinated ring compounds when it is used for bleaching pulp. However ozone is rarely practical in commercial installations because it is typically diluted in oxygen below a 10% concentration. Reactors for ozone therefore must deal with excess gas volume, or if ozone is utilized to ozonate a very dilute suspension of pulp, a large water volume must be dealt with. Also, ozone above a concentration of about 40% is violently explosive, and thus ozone must be handled carefully. This puts a practical limit on the concentration of ozone that may be utilized. Even at 40% concentration, there is too much ozone that is insoluble with oxygen to allow it to be used in conventional pulp processing.

According to the present invention it has been unexpectedly found that in the chlorination of pulp during bleaching to produce kraft pulp, the substitution of ozone for a part of the chlorine significantly reduces the adverse environmental consequences of the effluent, while allowing delignification to a greater extent than is possible with chlorine alone. The desired effects are achieved when ozone is added to a chlorine stream, that is when the chlorine and ozone are intimately mixed together and applied simultaneously to the pulp.

Practicing the invention it may also be possible to eliminate one or two stages from conventional bleach sequences in bleaching brown stock pulp to produce bleached kraft pulp. Typically four or five stages are necessary, however according to the invention by practicing an $O_3/Cl_2$ stage, then an $E_o$ stage, and then a D stage, utilizing only three stages it should be possible to produce pulp having a brightness of 90 TAPPI Absolute or greater.

According to one aspect of the present invention there is provided: a method of bleaching cellulosic fibrous material pulp during the production of kraft pulp comprising the step of supplying a mixture of ozone and chlorine to the pulp to effect bleaching, the ozone and chlorine being applied simultaneously to the pulp, and the mixture of ozone and chlorine containing about 1% to the violent explosion limit of ozone (e.g. about 40%).

According to another aspect of the invention there is provided: a method of chlorine bleaching cellulosic fibrous material pulp during the production of kraft pulp without significantly affecting the degree of delignification produced by chlorine bleaching, comprising the step of: in the chlorine bleaching of the pulp, substituting ozone for a portion of the chlorine.

The invention also contemplates a method of producing 90 TAPPI Absolute, or greater, brightness kraft pulp by bleaching brown stock pulp in only three bleaching stages, the three bleaching stages comprising an $O_3Cl_2$ stage in which ozone and chlorine are simultaneously applied to the pulp, an $E_o$ stage, and a D stage.

According to the invention a low fish toxicity effluent discharge from a kraft pulp bleaching facility produced by subjecting brown stock pulp to bleaching action of a mixture of about 1% to the violent explosion limit of ozone with chlorine, the ozone and chlorine being intimately simultaneously applied to the pulp to produce bleached pulp and effluent. The effluent has reduced total chlorinated ring compounds compared to obtaining comparable bleaching action utilizing chlorine alone.

It is the primary object of the present invention to provide for more effective and/or environmentally acceptable bleaching of pulp with chlorine during the production of kraft pulp. This and other objects of the invention will become clear from an inspection of the detailed description of the invention, and from the appended claims.

DETAILED DESCRIPTION OF THE INVENTION

Figure 1:
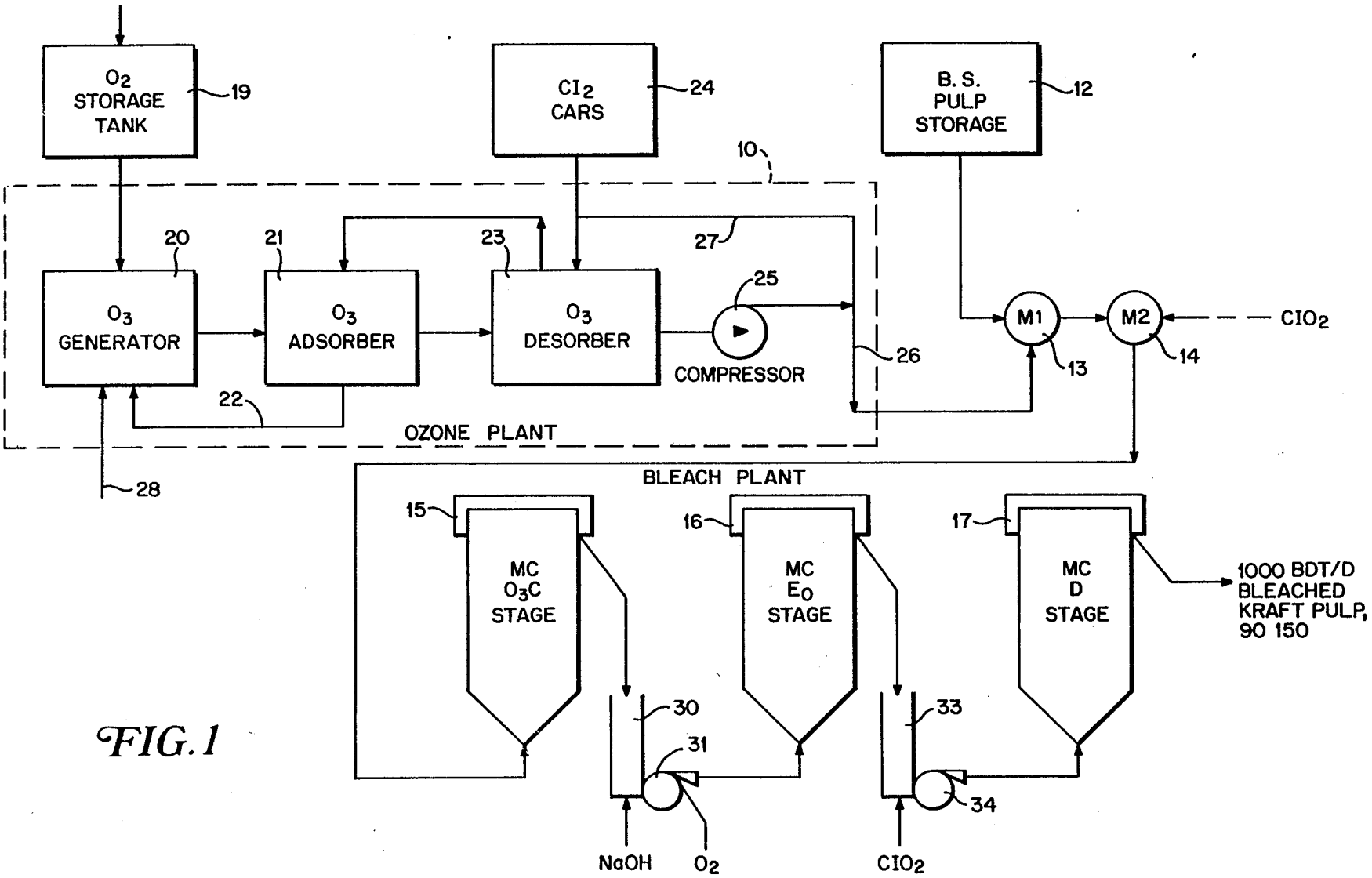
FIG. 1 is a schematic view of a bleach plant for practicing the method according to the present invention.

A variety of different installations and apparatus may be utilized to practice bleaching according to the invention, that is bleaching with both ozone and chlorine, wherein the ozone and chlorine are added together, simultaneously, to the pulp and intimately mixed with the pulp. Utilizing an ozone-oxygen-chlorine mixture it is possible to effect bleaching utilizing a conventional high consistency (e.g. 16+% consistency) gas phase reactor, or a conventional very low consistency (e.g. about ½% consistency) reactor, or a conventional medium consistency (about 6–15%, e.g. 9–12%) reactor with multiple addition points, and degassing of the residual oxygen gas between the addition points. However, a preferred form of installation utilizable for practicing bleaching according to the invention is illustrated in FIG. 1. In this installation, because of the higher brightness ceiling made possible by substituting some of the chlorine with ozone, a three stage plant may be capable of producing pulp having a brightness of 90 TAPPI Absolute or greater, eliminating one or two additional stages that are conventionally necessary.

In the exemplary apparatus of FIG. 1, an ozone plant is shown schematically by reference numeral 10, a brown stock (e.g. from soft wood) pulp storage facility (tower) by reference numeral 12, a pair of mixers connected in series, 13, 14, and three upflow bleaching towers, a first stage tower 15, a second stage tower 16, and a third stage tower 17. In order to produce ozone directly at the installation, oxygen from an oxygen storage tank 19 is fed to a conventional ozone generator 20. The ozone output from the generator 20 goes to an ozone absorber 21 with oxygen recycled in line 22, and the output from the absorber 21 goes to a desorber 23. Chlorine from chlorine tank cars 24 passes to the desorber 23, with the ozone/chlorine output from desorber 23 passing to compressor 25. In the absorber 21 a fluorocarbon adsorbent transfers the ozone from its oxygen environment to the chlorine environment. The ozone/chlorine from compressor 25 passes through line 26 to the mixers 13, 14. A by-pass line 27 is provided directly from the chlorine cars 24 for start-up, and power is supplied to the ozone generator as indicated by reference numeral 28.

In an exemplary production for a 1,000 BDT/D bleach plant, 11.8 T/D oxygen would be supplied to tank 19, with 0.6% oxygen at 5.8 T/D fed to the generator 20. 3.2 kwH power is provided per pound of ozone generated, or about 1,550 kw. The oxygen/ozone mixture from generator 20 preferably would be about 7% $O_3$ by volume, or about 5.8 T/D ozone. The absorber and desorber would typically be about 93% efficient. From the chlorine cars 24 5% chlorine would be provided at 50 T/D, so that five tons per day ozone and 50 tons per day chlorine would be supplied to the compressor 25. The amount of pulp provided from brown stock storage 12 would be 1060 BDT/D.

Typically the installation of FIG. 1 would operate at medium consistency, preferably 9–12% consistency pulp. The mixers 13, 14 would be conventional mixers such as those sold by Kamyr, Inc. of Glens Falls, New York under the trademark "MC", which effect fluidization of the pulp and intimate mixing of the ozone and chlorine mixture with the pulp. Chlorine dioxide may optionally be added to the second mixture 14 where desired.

The pulp exiting the second mixer 14 passes to the bottom of a flow first stage reactor 15. The reactor 15 also handles the pulp at medium consistency, and the ozone/chlorine bleaching takes place there. The pulp discharged from the top of first stage 15 passes to stand pipe 30, at which point caustic (NaOH) is added and the pulp is withdrawn from the stand pipe 30 by a suitable pump 31 which pumps the pulp to the bottom of the second stage upflow reactor 16. Some oxygen is also added at the discharge of the pump 31. Typically about 3.5% sodium hydroxide would be added to the pulp, and about 0.6% oxygen, for about 35 tons per day consumption of caustic and about 6 tons per day consumption of oxygen.

After bleaching in the second, $E_o$, stage 16, the pulp, still at medium consistency (e.g. about 6–15%), is fed to stand pipe 33 at which point chloride dioxide is added. Typically the chlorine dioxide would be added at about 1.3%, or about 13 tons per day consumption of chlorine dioxide. From the stand pipe 33 the pulp is pumped by a suitable pump 34 to the bottom of the third, D, bleach stage 17. Utilizing the installation illustrated in FIG. 1 it is possible to produce 1,000 BDT/D of bleached kraft pulp having a brightness of 90 ISO or greater.

In utilizing ozone as a substitute for some of the chlorine that would typically be utilized in a bleaching sequence, one would expect to see ozone as a partial replacement for the chlorine with perhaps a lower viscosity, but not any other truly significant changes. However, according to the invention it has been found that it is possible delignify to an extent greater than chlorine can at any dosage, and that viscosity is high, when the ozone and chlorine are added together.

The amount of chlorine that is substituted for by ozone can be significant since ozone has approximately three-fold the delignification power of chlorine. Typically, the ozone would comprise about 1–21% of the mixture (oxygen, or other components, could also be provided as long as not in significantly large enough amounts to adversely affect the bleaching process). For example the mixture may comprise 5% chlorine and 0.5% ozone, so that 1/11th of the actual chlorine/ozone mixture (in water, not considering the water), or 16 of the actual ozone/chlorine mixture, could be ozone. Percentages of about 7–10% ozone would be effective in many circumstances.

Figure 2:
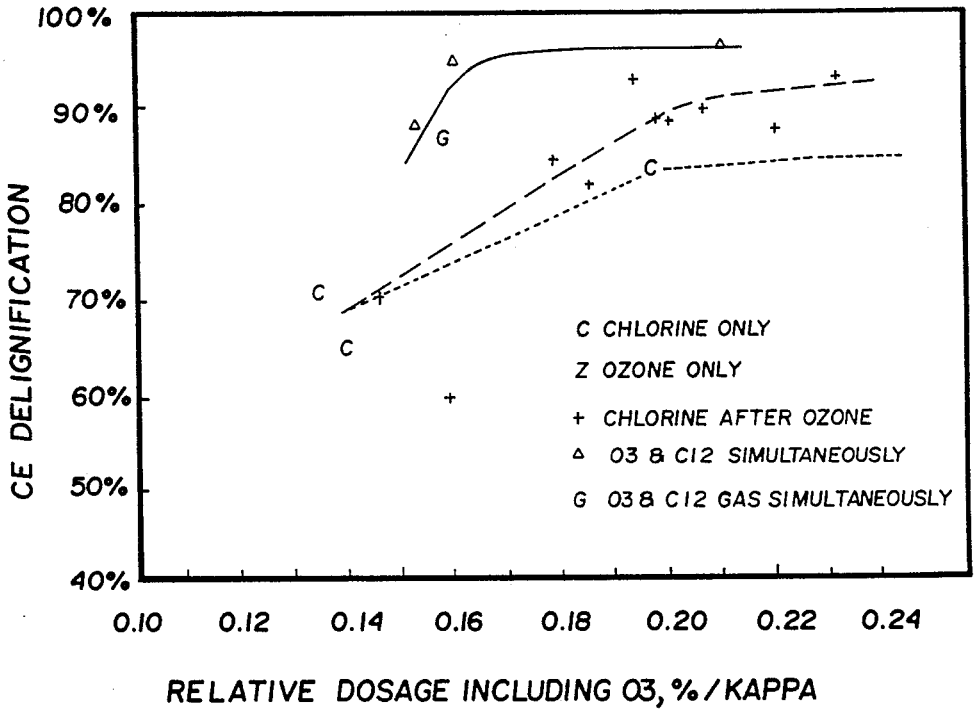
FIG. 2 is a graphical representation of delignification vs. the relative dosage of bleachant expressed in %/Kappa.
Figure 3:
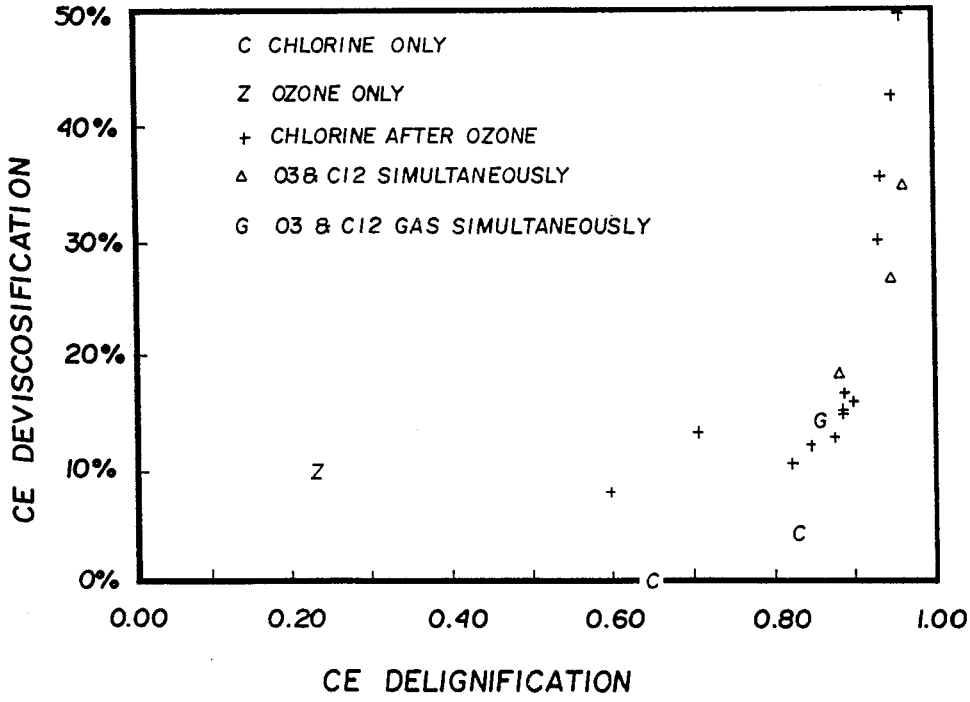
FIG. 3 is a graphical representation of deviscosification vs. delignification for the same runs as provided in FIG. 2.

The comparative results obtained in bleaching according to the invention, as opposed bleaching with chlorine alone (or ozone alone) are provided in the following tables. Table I shows the results for bleaching a particular type of soft wood when chlorine alone, or ozone alone, is utilized, while Table II shows bleaching the same wood with ozonation followed by chlorination, and Table III illustrates bleaching of the same wood with simultaneous addition of ozone and chlorine—that is Table III illustrates the results according to the invention. In Table III three of the runs are with water addition of ozone and chlorine, and the fourth of a gaseous ozone and chlorine mixture, alone. The results of these tables are plotted out in FIGS. 2 and 3, which provide graphical representations of these results. These results indicate the desirable bleaching action provided by the chlorine/ozone mixture bleaching according to the invention.

TABLE I

OZONATION FOLLOWED BY CHLORINATION
CHLORINATION ONLY

| | Chlorine Only | | | Ozone Only |
|---|---|---|---|---|
| Chlorine Applied | 4.80 | 6.5 | 5 | 0 |
| Chlorine Residual | 0.24 | 0.08 | 0.04 | 0 |
| Ozone Applied | 0.00 | 0.00 | 0.00 | 1.15 |
| Ozone in Trap | 0.00 | 0.00 | 0.37 | 0.67 |
| Estimate Ozone Dosage | 0.00 | 0.00 | 0.00 | 0.48 |
| Total Equivalent C12 Consumed | 4.56 | 6.42 | 4.41 | 0.71 |
| Initial Kappa | 32.6 | 32.6 | 32.6 | 32.6 |
| CE Kappa | 11.5 | 5.4 | 9.4 | 25.1 |
| Initial Viscosity | | | | |
| TAPPI | 53.1 | 53.1 | 53.1 | 53.1 |
| SCAN | 1222. | 1222. | 1222. | 1222. |
| CE VISCOSITY | | | | |
| TAPPI | 52.7 | 46.4 | 55 | 37.3 |
| SCAN | 1220. | 1175. | 1235. | 1099. |
| CE Delignification | 64.72% | 83.44% | 71.17% | 23.01% |
| CE Deviscosification | 0.22% | 3.84% | 1.00% | 10.06% |
| Relative Dosage | 0.140 | 0.197 | 0.135 | 0.022 |
| Symbols for Graphs | C | C | C | Z |

TABLE II

OZONATION FOLLOWED BY CHLORINATION

| | | | | | | | | | | | | | |
|---|---|---|---|---|---|---|---|---|---|---|---|---|---|
| Chlorine Applied | 4.8 | 6.7 | 6.5 | 6.5 | 6 | 5 | 4 | 3 | 6.5 | 6.5 | 6.5 | 5 | 5 |
| Chlorine Residual | 0.05 | 1.2 | 0.1 | 0.57 | 0.27 | 0.02 | 0.07 | 0.03 | 0.41 | 0.11 | 0.79 | 0.49 | 0.51 |
| Ozone Applied | 1.32 | 1.70 | 0.59 | 1.74 | 1.78 | 1.83 | 2.13 | 2.43 | 1.70 | 0.77 | 4.03 | 3.74 | 5.19 |
| Ozone in Trap | 1.02 | 1.15 | 0.50 | 1.34 | 1.29 | 1.26 | 0.70 | 1.22 | 1.26 | 0.24 | 1.76 | 1.69 | 1.76 |
| Estimated Ozone Dosage | 0.55 | 0.71 | 0.25 | 0.73 | 0.74 | 0.76 | 0.89 | 1.01 | 0.71 | 0.32 | 1.68 | 1.56 | 2.17 |
| Total Equivalent | 5.19 | 6.31 | 6.53 | 6.52 | 6.45 | 5.82 | 6.05 | 4.76 | 6.74 | 7.17 | 9.07 | 7.54 | 9.56 |

TABLE II-continued

| OZONATION FOLLOWED BY CHLORINATION | | | | | | | | | | | | | |
|---|---|---|---|---|---|---|---|---|---|---|---|---|---|
| C12 Consumed | | | | | | | | | | | | | |
| Initial Kappa | 32.6 | 32.6 | 32.6 | 32.6 | 32.6 | 32.6 | 32.6 | 32.6 | 32.6 | 32.6 | 32.6 | 32.6 | 32.6 |
| CE Kappa | 13.1 | 2.3 | 3.7 | 3.7 | 3.6 | 5 | 5.8 | 9.6 | 3.3 | 4 | 1.7 | 2.2 | 1.4 |
| Initial Viscosity | | | | | | | | | | | | | |
| TAPPI | 53.1 | 53.1 | 53.1 | 53.1 | 53.1 | 53.1 | 53.1 | 53.1 | 53.1 | 53.1 | 53.1 | 53.1 | 53.1 |
| SCAN | 1222. | 1222. | 1222. | 1222. | 1222. | 1222. | 1222. | 1222. | 1222. | 1222. | 1222. | 1222. | 1222. |
| CE Viscosity | | | | | | | | | | | | | |
| TAPPI | 40.1 | 18.4 | 31 | 31.4 | 29.5 | 34.5 | 36.5 | 33.2 | 30.2 | 33.7 | 11.8 | 15.2 | 9.2 |
| SCAN | 1125. | 853.7 | 1035. | 1039. | 1018. | 1072. | 1092. | 1059. | 1026. | 1064. | 699.0 | 787.2 | 612.3 |
| CE Delignification | 59.82% | 92.94% | 88.65% | 88.65% | 88.96% | 84.66% | 82.21% | 70.55% | 89.88% | 87.73% | 94.79% | 93.25% | 93.71% |
| CE Deviscosification | 8.00% | 30.18% | 15.33% | 14.96% | 16.74% | 12.28% | 10.68% | 13.37% | 16.07% | 12.95% | 42.84% | 35.62% | 49.92% |
| Relative Dosage | 0.159% | 0.194% | 0.200% | 0.200% | 0.198% | 0.179% | 0.185% | 0.146% | 0.207% | 0.220% | 0.278% | 0.231% | 0.293% |
| Symbols for Graphs | + | + | + | + | + | + | + | + | + | + | + | + | + |

TABLE III

| SIMULTANEOUS ADDITION OF $O_3$ and $Cl_2$ | Water | | Gas | |
|---|---|---|---|---|
| Chlorine Applied | 5 | 5 | 5 | 5 |
| Chlorine Residual | 0.15 | 0.09 | 0.09 | 0.06 |
| Ozone Applied | 1.15 | 2.47 | 4.24 | 1.30 |
| Ozone in Trap | 1.06 | 2.26 | 2.93 | 1.16 |
| Estimated Ozone Dosage | 0.48 | 1.03 | 1.77 | 0.54 |
| Total Equivalent C12 Consumed | 4.98 | 5.22 | 6.85 | 5.15 |
| Initial Kappa | 32.6 | 32.6 | 32.6 | 32.6 |
| CE Kappa | 3.9 | 1.8 | 1.3 | 4.6 |
| Initial Viscosity | | | | |
| TAPPI | 53.1 | 53.1 | 53.1 | 53.1 |
| SCAN | 1222. | 1222. | 1222. | 1222. |
| CE Viscosity | | | | |
| TAPPI | 28.1 | 21 | 15.8 | 32.4 |
| SCAN | 1001. | 899.8 | 800.7 | 1050. |
| CE Delignification | 88.04% | 94.48% | 96.01% | 85.89% |
| CE Deviscosification | 18.12% | 26.42% | 34.52% | 14.07% |
| Relative Dosage | 0.153 | 0.160 | 0.210 | 0.158 |
| Symbols for Graph | * | * | * | G |

Not only does the practice of the invention result in advantageous bleaching results, it greatly reduces the amount of chlorinated ring compounds produced by the bleaching sequence with chlorine. Total chloral-ring compounds are the main source of fish toxicity. Table IV, below, illustrates the significant affect achieved in reducing total chlorinated ring compounds according to the invention.

TABLE IV

| BLEACHANTS | Targets | | | |
|---|---|---|---|---|
| | 6.5% $Cl_2$ 0.0% $O_3$ | 4.8% $Cl_2$ 0.0% $O_3$ | 5.0% $Cl_2$ 0.5% $O_3$ | 5.0% $Cl_2$ 1.0% $O_3$ |
| 3,4,5 Trichloroguaiacol | 128 | 26.1 | 30.7 | 29.5 |
| 4,5;6 Trichloroguaiacol | 7.1 | 3.0 | 4.1 | 2.8 |
| 345 Trichlorocatechol | 355 | 65.9 | 78.5 | 125 |
| Tetrachlorocatechol | 135 | 43.2 | 34.8 | 57.4 |
| 4.5 Dichloroguaiacol | 1.2 | 1.2 | 1.2 | 1.2 |
| Total (mgll) | 625 | 138 | 148 | 215 |
| CE Kappa | 5.0 | 11.5 | 3.9 | 1.8 |
| 246 Trichlorophenol | 29.1 | 59.1 | 46.6 | 27.7 |
| 234 Trichlorophenol | 0.9 | 0.9 | 2.7 | 3.1 |
| 2356 Tetrachlorophenol | 10.8 | 7.9 | 4.4 | 5.7 |
| 2346 Tetrachlorophenol | 1.3 | 0.3 | 0.6 | 0.5 |
| 2345 Tetrachlorophenol | 14.0 | 4.1 | 3.5 | 5.0 |
| Pentachlorophenol | 1.4 | 1.9 | 0.9 | 3.5 |
| Total Chlorophenol (mgll) | 57.5 | 74.2 | 58.7 | 45.5 |
| Total Chlorinated Ring Compounds | 682 | 212 | 207 | 260 |

Analyzed by capillary gas column chromatography with electron capture detector. Identification is based on comparison of retention times of samples chromatographed under identical conditions as purchased standards.

Viewing Table IV, the bleaching results achieved by using 5.0% chlorine and 0.5% ozone is as good as, or better than (considering most criteria), the results achieved by utilizing 6.5% chlorine. However because 1.5% chlorine was eliminated in the mixture, the total chlorinated ring compounds was reduced from 682 micrograms per liter to 207 micrograms per liter. This makes practice of the invention eminently suited for any installation which has fish toxicity or like environmental problems with the effluent from the system. The effluent produced according to an installation practicing the method of the invention would have reduced chlorinated ring compounds per unit brightness compared with a plant using only chlorine instead of a chlorine/ozone sequence, and thus would be much more acceptable from the environmental standpoint.

It will thus be seen that according to the invention an environmentally superior, and/or enhanced brightness result-achieving, bleaching method is provided according to the invention, for bleaching cellulosic fibrous material pulp to produce kraft pulp. Utilizing the invention brown stock softwood pulp may be turned into bleached kraft pulp having a brightness of 90 TAPPI Absolute or greater utilizing only three bleaching stages, the bleaching sequence being $(O_3Cl)\ E_0D$. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods, procedures, and products.

What is claimed is:

1. A method of chlorine bleaching cellulosic fibrous material pulp at a consistency between about ½–15% solids during the production of kraft pulp without significantly affecting the degree of delignification produced by chlorine bleaching, comprising the step of: in the chlorine bleaching of kraft pulp at a consistency of about ½–15%, substituting ozone for a portion of the chlorine by providing a mixture of chlorine and ozone applied to the pulp simultaneously, the amount of ozone in the mixture being between 1–40% by volume.

2. A method as recited in claim 1, wherein the mixture contains other materials which do not adversely affect bleaching.

3. A method as recited in claim 2 wherein the mixture also includes oxygen.

4. A method as recited in claim 1 wherein the mixture of ozone and chlorine is gaseous.

5. A method as recited in claim 1 wherein the mixture of ozone and chlorine is liquid.

6. A method as recited in claim 1 for producing 90 TAPPI Absolute, or greater, brightness kraft pulp by bleaching brown stock pulp in only three bleaching stages, the three bleaching stages comprising sequentially an $O_3Cl_2$ stage in which ozone and chlorine are simultaneously applied to the pulp, an $E_o$ stage, and a D stage.

7. A method as recited in claim 6 wherein said three stage bleaching sequence is practiced in three distinct upflow reactors.

8. A method as recited in claim 7 wherein said first bleaching stage is practiced by intimately mixing the ozone-chlorine mixture with the brown stock pulp in first and second series connected mixers, and then upflowing the pulp in an upflow 9. A method as recited in claim 8 wherein the amount of ozone in the mixture of ozone and chlorine is about 7–10% by volume, and wherein the mixture consists essentially of ozone and chlorine.

10. A method as recited in claim 1 wherein the amount of ozone in the mixture of ozone and chlorine is about 7–10% by volume, and wherein the mixture consists essentially of ozone and chlorine.

* * * * *